US005806548A

United States Patent [19]

Goldstein et al.

[11] Patent Number: 5,806,548

[45] Date of Patent: Sep. 15, 1998

[54] QUADCANE WITH ADJUSTABLE STANCE

[76] Inventors: Jeffery P. Goldstein; Herb J. Barrack, Jr.; Albert A. Williams, Jr., all of 5161 Avenida Playa Cancun, San Diego, Calif. 92124

[21] Appl. No.: 675,049

[22] Filed: Jul. 3, 1996

Related U.S. Application Data

[63] Continuation-in-part of Ser. No. 301,546, Sep. 6, 1994, abandoned.

[51] Int. Cl.[6] ..... A45B 1/00

[52] U.S. Cl. ..... 135/65; 135/77; 135/75

[58] Field of Search ..... 135/65, 69, 75, 135/77, 82, 86

[56] References Cited

U.S. PATENT DOCUMENTS

| | | | |
|---|---|---|---|
| D. 290,186 | 6/1987 | Meunchen | D3/9 |
| 2,642,074 | 6/1953 | Pedley | 135/45 |
| 2,811,978 | 11/1957 | Russell | 135/45 |
| 3,289,685 | 12/1966 | Parker | 135/45 |
| 3,550,602 | 12/1970 | Hesterman | 135/45 |
| 4,044,784 | 8/1977 | Smith | 135/45 |
| 4,085,763 | 4/1978 | Thomas | 135/69 |
| 4,091,828 | 5/1978 | Jorgensen | 135/66 |
| 4,274,430 | 6/1981 | Schaaf et al. | 135/65 |
| 4,528,998 | 7/1985 | Gamm | 135/75 |
| 4,997,001 | 3/1991 | DiCarlo | 135/65 |
| 5,036,873 | 8/1991 | Clayton | 135/69 |
| 5,331,990 | 7/1994 | Hall et al. | 135/65 |
| 5,390,687 | 2/1995 | Tsai | 135/77 X |

*Primary Examiner*—Lanna Mai

*Attorney, Agent, or Firm*—Gene Scott—Patent Law & Venture Group

[57] ABSTRACT

A special configured rehabilitating quadcane implement providing major advancements in the art; including: a.) positive vertical incremental adjustment of staff height to suit user; b.) the staff is readily rotatable 180°, so as to facilitate both left and right hand usage; c.) during final stages of rehib-recovery the cane-staff may be extracted from the quadleged-base spider via provision of a special safety-lock turn-flap device, enabling monocane use; d.) each of the quadlegs are independently adjustable as to ground-spread, thereby accommodating different stability requirements of patients. Most of the adjustments are provided via a well known spring-tensioned button-detent indexing device, whereby detent-holes are staged at regular intervals. Moreover, the adjustable quadlegged-base enables the user to align the leading edges of the two frontal-legs, so that the cane staff rocks forward exactly inline with the direction of walking.

3 Claims, 4 Drawing Sheets

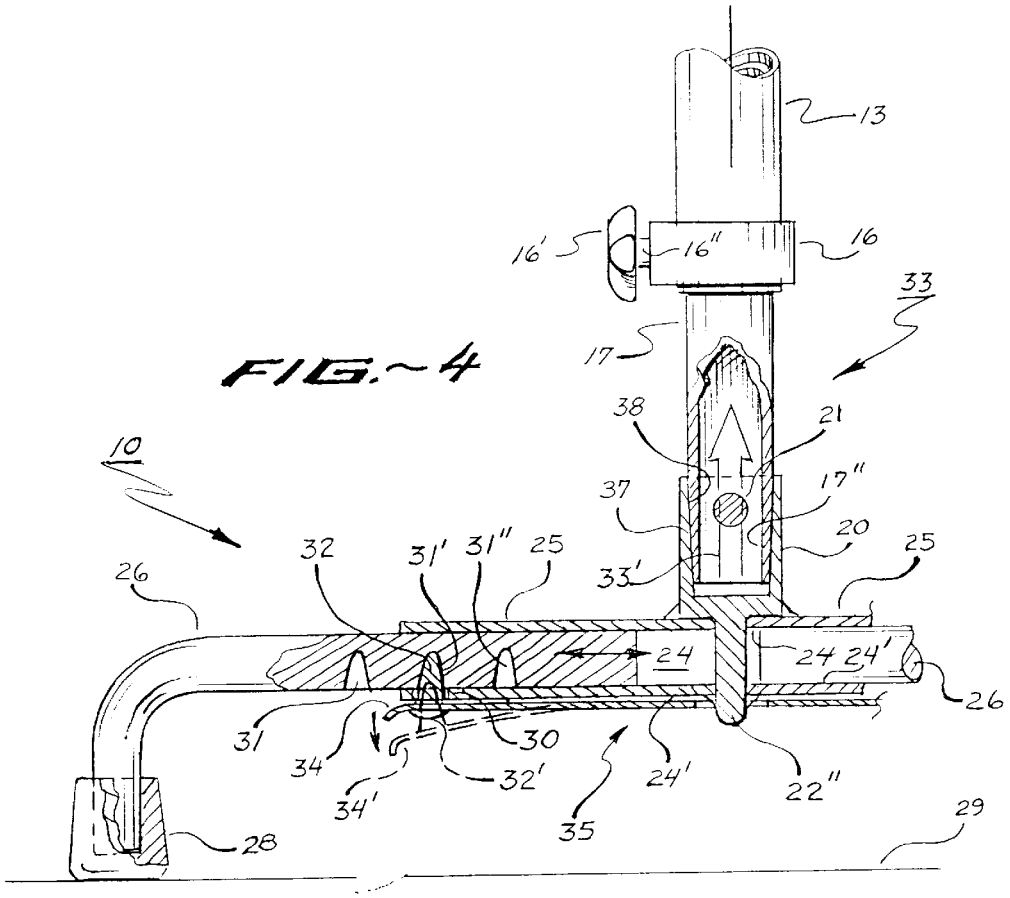
FIG.~4
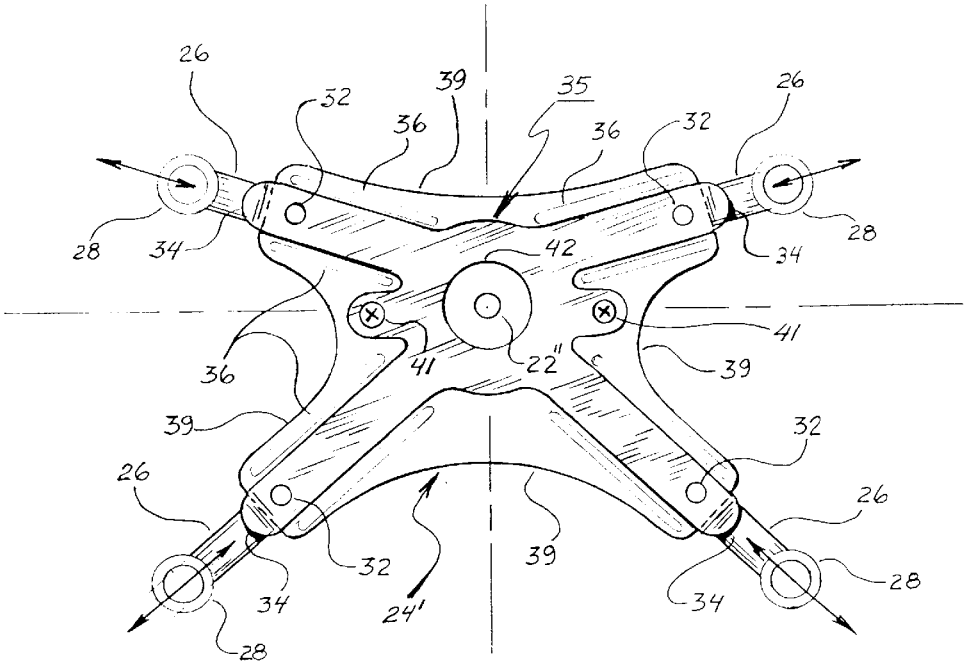
FIG.~5

QUADCANE WITH ADJUSTABLE STANCE

This application is a continuation-in-part of U.S. application Ser. No. 08/301,546 filed Sep. 4, 1994, now abandoned.

I.) PROBLEMATICAL BACKGROUND OF RELEVANT EARLIER INVENTION

This invention relates to rehabilitation-canes, and more specifically it relates to those types of rehab.-quadcanes featuring some manner of adjustability serving to improve adaptation to a particular user.

Heretofore, various improvements have been documented in the form of patents regarding rehabilative walking-canes, background research discovery provides some prior patent-art regarded as germane to this disclosure, chronologically for example early U.S. Pat. No. 2,642,074 (filed: April 1949) sets forth an invalid's universal walking triadcane; featuring both a vertically adjustable staff portion, as well as both a fixed triangular footing member and a retractable footing member version thereof.

In U.S. Pat. No. 2,811,978 (filed: March 1955) a five-legged walking-cane; characterized as having a central vertical staff member with a handle at the upper distal end, and a rubber-tipped leg at the lower distal end, plus four outrigger-legs radiating from the lower region of the staff as stabilizers. A spring biased detent-button is provided on the staff, for vertical height adjustment.

In U.S. Pat. No. 3,289,685 (filed: October 1964) shows a walker's quadcane which is provided with a vertically adjustable hand-grip which formed an F-shaped cane-staff configuration.

U.S. Pat. No. 3,550,602 (filed: May 1969) which shows a vertical walking-cane having an attachable quad-pod which four legs are made adjustable as to radial deployment from the walking-cane's vertical-staff.

U.S. Pat. No. 4,044,784 (filed: March 1976) shows a walker's quadcane which has since become a very popular configuration, featuring a special spring-biased dual-opposed button-detent type of manually adjustable vertical-staff height adjustment. Plus, the two outrigger type stabilizer-legs arranged outwardly from the user's side, are splayed at a narrower angle but are longer than the two wider-splayed legs facing somewhat toward the user's side; thus the tips of the four stabilizer-legs each distend down into four-corners of an imaginary rectangle, which is laterally outset from the vertical-axis of the cane-staff. Thus insuring that a transverse-line projected through the centers of both leading stabilizer-legs, is parallel with an imaginary transverse-line projected in plan-view across the user's shoulder's; thereby aiding the walker's stable line of travel. However, the four legs of this disclosu are non-adjustably fixed as to radial extension/retraction. But, for right/left usage, the uppermost asymmetrical shepherd's-handle (16) is made 180-degrees reversible relative to the quad-base portion; via provision of two oppositely arranged rows of vertically spaced indexing-holes located on the telescopic-staff.

U.S. Pat. No. 4,085,763 (filed: September 1976) shows a quadcane featuring vertical adjustability, wherein is provided a special sleeve-collar having a thumb-screw; whereby the user is given to feel more secure while walking in that "free-play" can be eliminated from the telescoping vertical-staff.

U.S. Pat. No. 4,091,828 (filed: March 1977) shows a manually controlled tripod arrangement, which is readily deployed via finger-tip lever at the cane-handle.

U.S. Design Pat. No. 290,186 (filed: April 1984) shows a particular configuration for a quadcane, including a vertically-adjustable staff member.

U.S. Pat. No. 4,997,001 (filed: September 1989) shows a quadcane easily changable into a monocane, via a single screw device facilitating detatchment of the quad-base portion. The monocane embodiment features a larger diameter lower-half portion and a smaller internally fitting upper-half telescopic portion.

Therefore, in full consideration of the preceding patent review, there is determined a need for further improved in the form of quadcane device to which these prior-art patents have been addressed. The instant inventor hereof believes their newly improved quadcane device, commercially referred to as the 4-Way/Progressive-cane™, currently being developed for production under auspices of the DME-Mfg./Mkt. Co., exhibits certain advantages as shall be revealed in the subsequent portion of this instant disclosure.

II.) SUMMARY OF THE INVENTION

A.) In view of the foregoing discussion about the earlier invention art, it is therefore important to make it pellucid to others interested in the art that the object of this invention is to provide a rehabilative quadcane type of DME (durable medical equipment)—device which can be made adjustably attuneable four ways to suit a rehab. patient's particular physical disability and stature.

B.) Another object of this invention disclosure is to set forth a special quadcane article wherein is provided a special quadspider-base portion which is readily detatchable from the primary cane-staff via a special transverse screw-pin having a novel safety-locking turn-flap, or even via a more conventional ball-tipped detent-lug; thereby facilitating use of the cane as a regular monocane subassembly if so desired. The primary cane-staff member is preferably essentially comprised of a first/upper-outer tubular section having an upper distal handle portion, plus a second lower-inner tubular section having a lower distal portion having provisional anchoring means.

C.) Another object of this invention disclosure is to set forth a special quadcane article wherein is provided a tubular telescopic primary vertical-staff member having on it's first section a plurality of vertically spaced indexing-holes serving as regular increments by which the co-acting secondary tubular staff portion may be adjusted to a desired height. By means of a conventional thumb actuated hairpin-spring biased ball-tipped indexing-lug, the two tubular sections are held positively in a selected extension position.

Additionally, it is preferred that the said first/upper-outer section include a special lower distal annular collar into which a transverse thumb-screw is arranged, so that once the vertical-height of the staff is selected, the thumb-screw may be engaged to eliminate any vestige of free-play prevailing between the said first and second telescopic-tube sections; thereby making the cane feel more secure particularly to the infirm user (substantially according to quadcane U.S. Pat. No. 4,085,763 (filed: September 1976).

D.) Another object of this invention disclosure is to set forth a special quadcane article according to preceding item-C, wherein is provided special coaxially opposed dual-detent ball-tipped/indexing-lugs (X & Y) each of which are conventional in design, although functioning in a uniquely cooperative manner to facilitate a special rotative capability, whereby the first mentioned upper external telescopic section may be undetented (via X) and rotated 180-degrees relative to the second lower internal section which is secured fast with the quadcane-base portion; the opposite detent-lug (Y) of the second section thus then becoming detentively re-indexed into one of the incremental-holes of the first section; -thereby conveniently facilitating either right or left handed usage at the very same selected detent-hole height. Note that in the prior-art (such as previously mentioned U.S. Pat. No. 4,085,763), the intrinsic symmetry of the handle/hand-grip (16) therefore leaves the thus unnecessary notion of a reversible-handle unanticipated. In affore mentioned U.S. Pat. No. 4,044,784 however, a more elaborate arrangement of two vertical-rows of indexing-holes in combination with dual/axially-opposed detenting-lugs, has by way of comparison hereto, been discovered to be overly complex and the second vertical-row somewhat weakening of the vertical staff. In U.S. Pat. No. 5,036,873 FIGS. 9 & 10 show another dual-opposed ball-tipped/indexing-lug arrangement, again demonstrating no possible anticipation as to instantaneous 180-degree rotational function advantage.

E.) Another object of this invention disclosure is to set forth a special quadcane article wherein is provided a quadspider-base (four-legged cluster) featuring individually telescoping-leg members, thereby enabling radial attenuation of the said base's stability according to user requirement. Each of the four legs thus being identified as: a.) a leading/inboard-external tube section, and a trailing/inboard-external tube section; plus, b.) a leading/outboard-internal tube section, and a trailing/outboard-external tube section; the first identified tube sections each include a spaced plurality of indexing-holes; it being preferred that each of these tube sections are permanently secured to the central mast portion of the quadspider-base assembly which is basically X-shaped in plan-view. Cooperating with each of these four fixed inboard sections, is an internally sliding tubular-leg portion which exhibits an inwardly facing straight portion which distally arches down to engage vertically upon the existing walking surface. The straight portion of these manually telescoping legs includes a conventional thumb released ball-tipped spring-biased indexing-lug arranged to selectively detent into one of the provided detent-indexing holes; thereby enabling selective adjustment of the base's footprint spread.

Also, it is preferred that the radial intersection between the outboard leading and trailing legs of the quadspider base be an approximate right-angle; while more importantly, the outset-angle of the outboard legs is approximately 50-degrees, and the inset-angle of the inboard legs is approximately 12-degrees; these inboard/outboard angles are measured relative to a line-of-reference which viewed in plan-view projects parallel with the handle-grip orientation of the cane.

Additionally, it is preferred that the mentioned angles and the interval locations provided on the external-tubes be critically arranged so that the leading-edges of both the leading legs (inboard & outboard) can be aligned in plan-view so that a ref-line-A projected through the user's hips and shoulders extends parallel with a ref.-line-B projected across the leading-edge of both those legs. This assures that the path of the cane as it rocks forward on the two leading-edges closely parallels that of the walking user, thus maximizing stability offered by the quadcane. Moreover, in the generic-variant embodiment of the invention having a rotating handle, the trailing-edges of the trailing-legs are to exhibit the same critical alignment just related here, since when switched from right-side to left-side the former trailing-edges become the leading-edges.

III.) DESCRIPTION OF THE PREFERRED EMBODIMENT DRAWINGS:

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the Claims section annexed hereto; and accordingly, a better understanding of the invention and the variant uses is intended, by reference to the drawings, which are considered as primarily exemplary and not to be therefore construed as restrictive in nature.

FIG. 4, is another cross-sectional side/elevation-view thereof, including phantom-outlined portions demonstrating spring flexion;

FIG. 5, is an under/plan-view revealing arrangement of a one-piece leaf-spring thereof.

Figure 1:
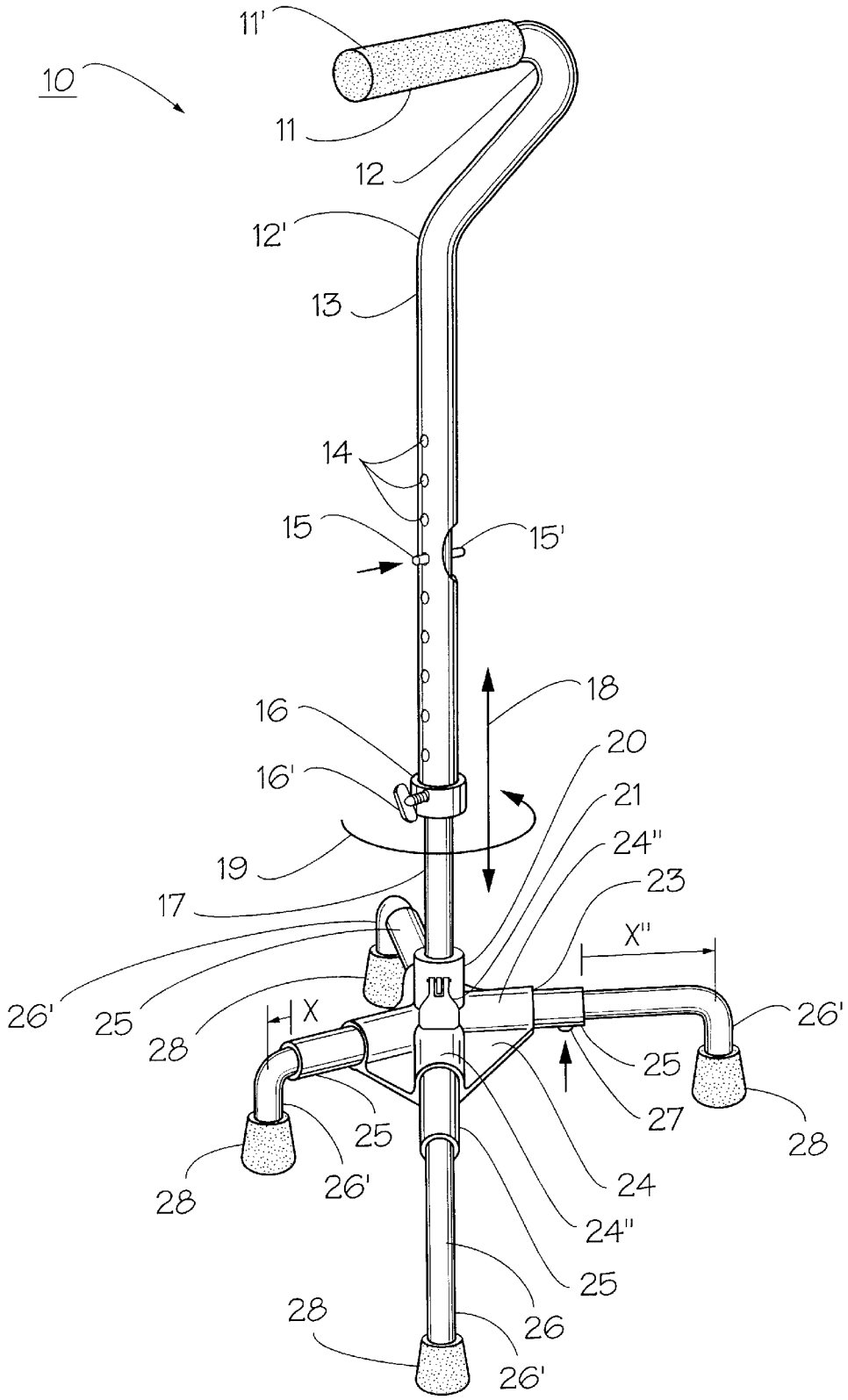
FIG. 1, is a pictorial perspective-view, favoring the outboard upper-rear portion of the cane invention.

IV.) ITEMIZED NOMENCLATURE REFERENCES:

10,10'-overall quadcane, quadspider-base
11,11'-handle-grip, handle-terminus
12/12'-shepherd's crook (upper/lower)
13-upper staff-shank
14-incremental adjustment indexing-holes
15,15'-detent button ball-tip, opposing coaxial detent-tip
16,16',16"-staff-shank collar, T-wingscrew, screw-shank
17,17'-lower staff-shank, terminus portion
18-vertical-adjustment ref.arrow
19-180-degree swivel ref.arrow
20,20',20"-stanchion-neck, receiver-bore, stabilizer-shank
21,21',21"-flap-lock, clevis-head, threaded-shank
22/22'-weldments (upper/lower)
23-leg weldments
24/24',24"-stabilizer-plate (upper/lower), optional U-shape portion
25,25'-external inboard-leg portion, outer terminus
26,26'-internal outboard-legs, downturn portion
27,27'-leg detent-lugs, hairpin-spring
28-leg rubber-tips
29-existing walking surface
30,30',30"-leg detent incremental indexing-holes

V.) DETAILED DESCRIPTION OF THE PREFERRED EMBODIMENTS

Figure 2:
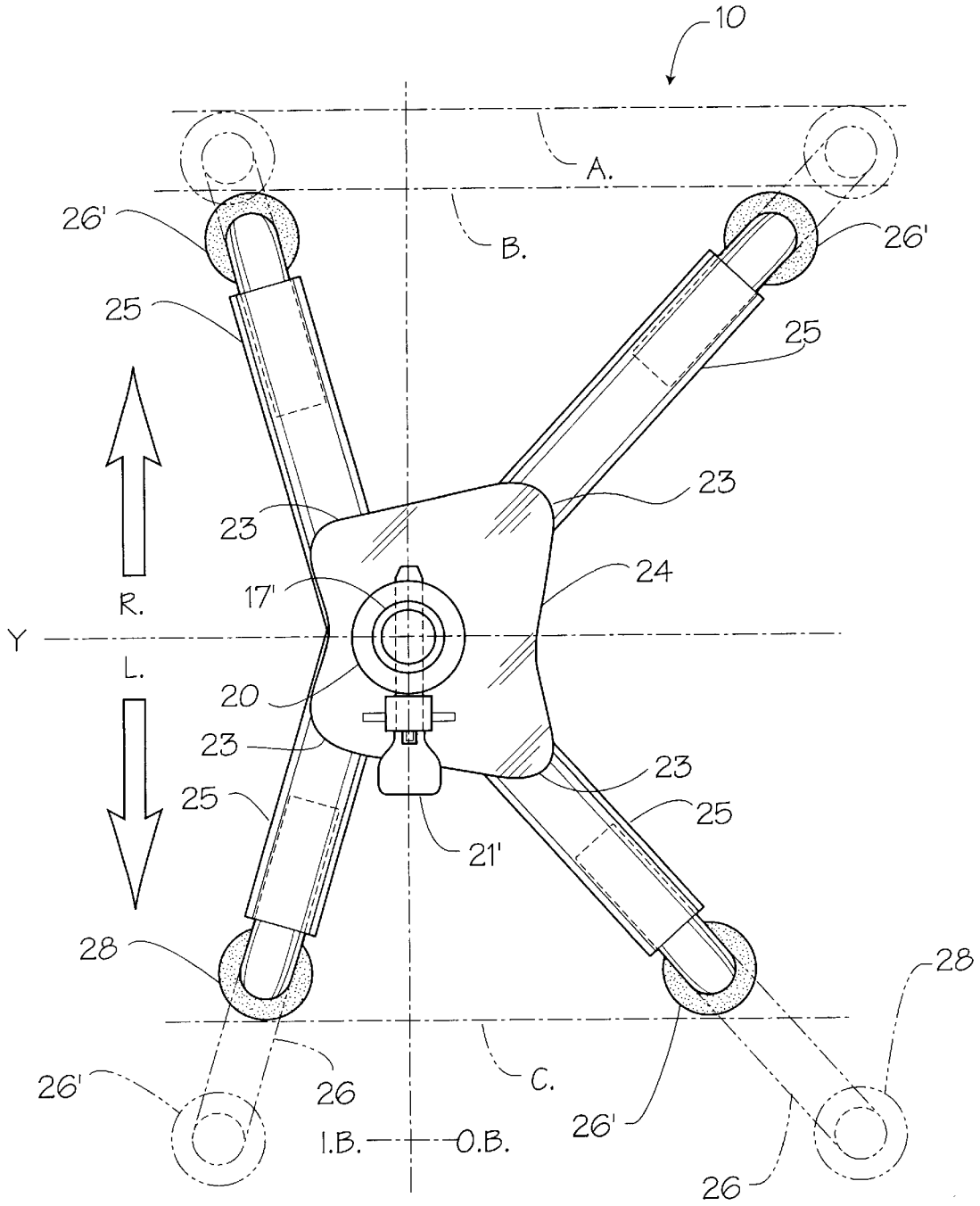
FIG. 2, is an upper/plan-view with phantom-outlined portions revealing critical structural relationships and adjustability movement.

Initial reference is given by way of FIG. 1, wherein is exhibited the fully assembled embodiment of our invention 10; noting here that this quadcane assembly may be readily converted into a monocane configuration via the simple expedient of detatching the lower staff's terminus 17' from the stanchion receiver-bore 20' as best revealed in FIG. 2. Whether employed in either quad or mono cane modality, it is preferred the vertical external staff portion 13 include an internally telescoping member 17, which is incrementally adjustable via a plurality of vertically spaced indexing-holes 14 into which a conventional, ball-tipped (or substantially equivalent tapered type) detent-button 15 may be introduced by way of selectively adjusting the height (ref.-arrow 18) of cane-handle 11.

Note also in FIG. 1 how orientation of the preferred sheperd's-crook type handle may be readily reversed 180-degrees, by simple expedient of manually depressing detent-button 15 fully into the tube portion 17, whereby the handle 11 may be freely rotated (provided the binding T-wingscrew 16' is releasable backed-out within locking-collar 16) per ref.arrow 19 and turned halfway around, whereby a second identical opposite detent-button automatically detents into the same indexing-hole. Hence, only one detent-button 15 is accessible at any given time. The novel arrangement of dual-opposed detent-buttons 15 and 15' (revealed via partial cut-away) serves to eliminate need for an otherwise twin opposed vertical plurality of indexing-holes 14; which by emiminating half the holes, tends to make a slightly stronger vertical-tube 13 as well as being more economical to manufacture. Further study details of both the staff-collar 16 (essentially serving to eliminate any disconcerting free-play between the telescoping-tubes) and the stanchion-neck 20, are found in FIG. 2 and cross-sectional FIG. 3.

Figure 3:
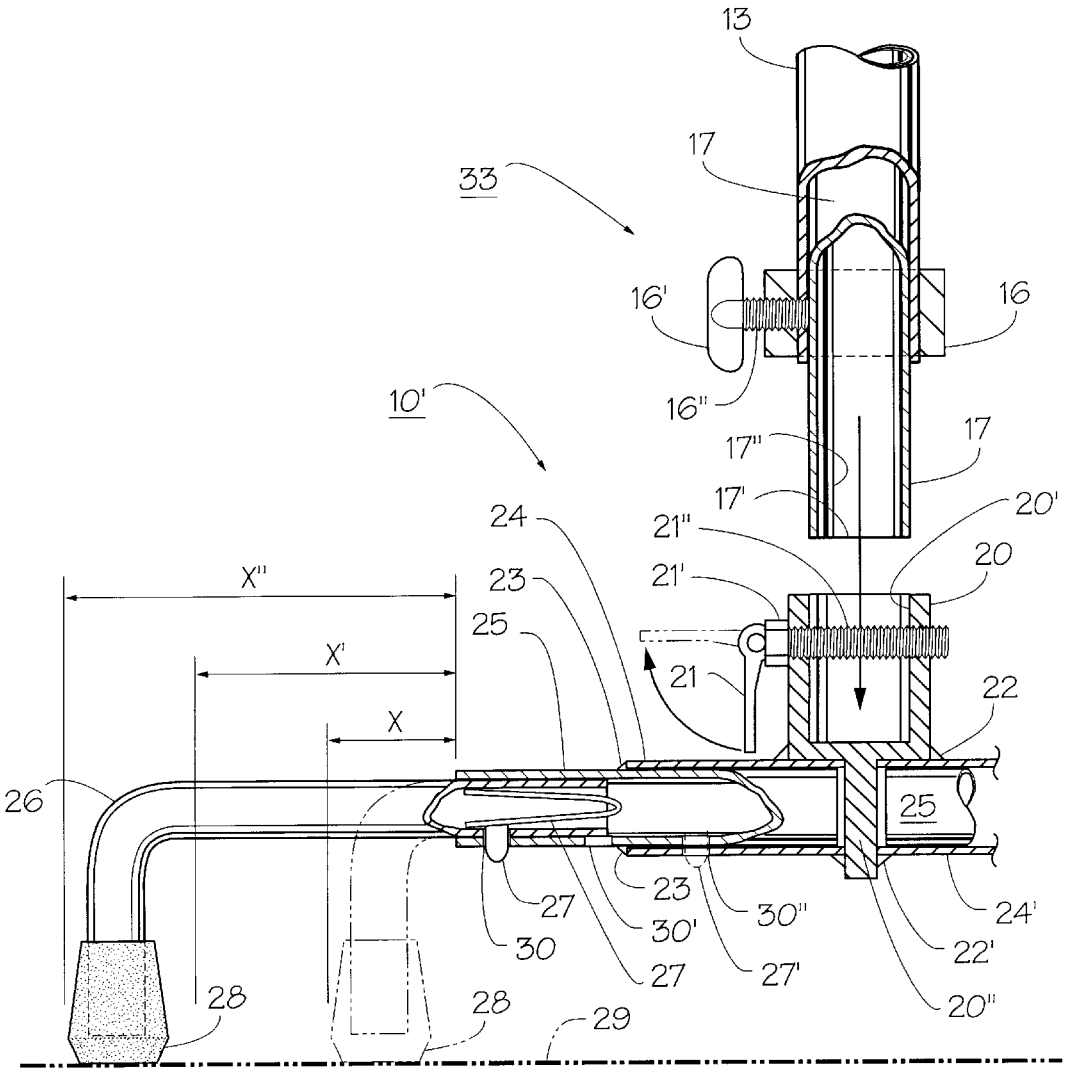
FIG. 3, is a cross-sectional side/elevation-view thereof, including phantom-outlined members to show adjustability movement.

Continued study of FIGS. 1, 2, 3, reveals how the four spider like legs in all examples of this invention, are able to be selectively adjusted radially in or out relative to the axis of the central staff-stanchion 20; as is indicated via ref.arrows-X,X',X". It is preferred this be accomplished in substantially a like manner to that demonstrated for the cane's staff, excepting that the dual-opposed detent-lug arrangement is not necessary. A single conventional (commercially available substantially as shown) detent-lug 27 receiving outward biasing preferably via a hairpin-spring 27' may be manually depressed and selectively re-entered into any one of the incrementally spaced indexing-holes 30,30',30". Note also in FIG. 2 how critical orientation of the quadspider base is graphically represented as X-shaped in plan-view, wherein the longitudinal reference-line marked I.B. (inboard) and O.B. (outboard) is projected relative to the center axis of staff 17'. Thus it may be observed that the preferred inset-angle splay of the two (leading & trailing) inboard-legs is approximately 12-degrees (conventional quadcanes usually exhibit 18-degrees here), while the preferred outset-angle splay of the two (leading & trailing) outboard-legs is approximately 50-degrees; both respective splays being thus measured as divergent from the identified longitudinal ref.-line.

Moreover, it is desirable to maintain critical alignment of the two leading-edges of the two leading-legs regardless as to the radial in/out-setting of the respective leading-legs; since we have found it very important that as the quadcane becomes naturally tipped or rocked-over forward during the user's forward walking procedure, that the rocking-direction of the quadcane staff 13/17 parallels the walking-path of the user. In other words, it is preferred that selective adjustment provision of the quadspider base enables the leading inboard-leg and outboard-leg to be adjusted radially in a manner aligning the leading-edges of both these legs in plan-view, so that an imaginary ref.line"-Y" projected through the user's hips & shoulders (not illustrated), extends parallel with the illustrated imaginary ref.lines-"A"&"B" (corresponding to indexing-holes 30 & 30' as exemplified relative to right-hand usage) or ref.lines-"C" (corresponding to minimum extension indexing-holes 30" as exemplified relative to left-hand usage) projected across the leading-edge of the cane's legs. This vital alignment assures that the path of the cane as it rocks forward on the two leading-edges, basically parallels that of the walking user; thereby maximizing inherent safety stability offered, and therefore promoting personal confidence induced, by our new quadcane apparatus. Furthermore, it is important to note, that owing to the earlier mentioned comparative splay-angles of the radially-adjustable legs, the ratio of incremental-spacing intervals prevailing between the indexing-holes 30/30'/30" are necessarily greater on the outboard-legs as compared to the inboard-legs; in order to maintain the stated desired leading-edge parallelism regardless as to stage of incremental radial-extension selected. Although this quality of critically aligned construction is not absolutely required in order that the invention hereof be realized, it is still a highly desirable characteristic.

Structural integrity of the quadspider-base may be addressed in one of several ways; for example in FIG. 1 a special stamped stabilizer-plate featuring inverted U-shaped recesses 24" into which are received and preferably welded the external inboard-leg tubes 25, which may extend inboard to the proximal central-axis region of the cane's stanchion-neck or stabilizer-shank 20". The U-shaped recesses are formed with joining-webs to complete the structural integrity; while in FIGS. 2 & 3 a more conventional gusset like flat-plate type of construction is suggested, which may comprise a single upper-plate 24, or a combination upper 24 and lower type 24' plate arrangement suggested per FIG. 3.

Additionally, it is to be understood that the handle-terminus portion 11' seen in FIG. 1 is designed to be pointed aftward while walking, thus in FIG. 2 the terminus (not illustrated but aligned along ref.line-"IB/OB") would appear to be pointing opposite to the direction of parallel ref.arrow-"R" during right-hand usage, and pointing opposite to the direction of parallel ref.arrow-"L" during left-hand usage.

When the quadcane user progresses to the stage of rehabilitation which permits transition into use of the monocane configuration, the lower-terminus portion 17' is made detachable by merely flipping-up the special flap-lock finger-hold 21 so that one may manually unscrew the threaded transverse-shank 21" joined to the flap-lock 21 via clevis and pin arrangement 21'. Extraction of the threaded-shank 21" thus allows the quadspider-base portion 10' to be separated from the 2-piece cane-staff 17/13, whereupon a rubber-tip 28 is simply installed over the terminus 17', and the height readjusted a bit longer via detent-lug 15 to compensate for removal from the base member. Note that the flap-lock 21 is considered a viable solution to securing of the cane staff to the spider-base, in as much as when it is in the natural gravity held downward position it is impinging proximally upon the adjacent radial leg tube 25 or stability-plate 24, and cannot unscrew until it is manually pivoted out and up 90-degrees, whereupon it may be turned manually without need of a tool.

Finally, it is readily understood how the preferred and generic-variant embodiments of this invention contemplate performing functions in a novel way not heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended Claims set out the scope of the invention sought, and are to be construed as broadly as the terminology therein employed permits, reckoning that the invention verily comprehends every use of which it is suseptible. Accordingly, the embodiments of the invention in which an exclusive property or proprietary privilege is claimed, are defined as follows.

What is claimed of proprietary inventive origin is:

1. An adjustable walking cane device comprising:

a base member providing at least three, approximately horizontally positioned, divergently oriented leg receivers, each of the receivers engaging a leg member in telescoping relationship therewith such that the leg members are inflexibly secured relative to the receivers, the leg members each providing a foot oriented for placement in contact with a ground surface;

an indexing means mutually adjusting each of the leg receivers and the respective leg member to one of a plurality of selected lengths; said indexing means comprises a plurality of indexing holes in each of the leg receiver, and a spring-biased lug in each of the leg members, each said lug being positionable into any of said indexing holes in one of the leg receivers.

2. The device of claim 1 further including a means for detaching the vertical staff for use of the staff without the base member.

3. The device of claim 1 wherein the spring-biased indexing lug includes a leaf spring biasing the lug toward the indexing holes, the lug being manually repositionable for movement of the leg member within the receiver.

* * * * *